US005975632A

United States Patent [19]

Ginat

[11] Patent Number: 5,975,632

[45] Date of Patent: Nov. 2, 1999

[54] CHAIR HAVING A BACKREST WITH AN ADJUSTABLE CONTOUR

[76] Inventor: Jonathan Ginat, 26 W. 9th St., New York, N.Y. 10011

[21] Appl. No.: 09/145,603

[22] Filed: Sep. 2, 1998

[51] Int. Cl.[6] ..... A47C 7/46

[52] U.S. Cl. ..... 297/284.7; 297/284.4

[58] Field of Search ..... 297/284.4, 284.7

[56] References Cited

U.S. PATENT DOCUMENTS

| | | | |
|---|---|---|---|
| 2,991,124 | 7/1961 | Schwarz | 297/284.7 X |
| 3,642,319 | 2/1972 | Berchicci . | |
| 3,948,558 | 4/1976 | Obermeier et al. . | |
| 4,156,544 | 5/1979 | Swenson et al. . | |
| 4,601,514 | 7/1986 | Meiller . | |
| 4,730,871 | 3/1988 | Sheldon | 297/284.7 |
| 5,112,106 | 5/1992 | Asbjornsen et al. | 297/284.7 |
| 5,217,278 | 6/1993 | Harrison et al. . | |
| 5,660,438 | 8/1997 | Tedesco . | |

FOREIGN PATENT DOCUMENTS

| | | | |
|---|---|---|---|
| 224002 | 12/1968 | Sweden | 297/284.7 |
| 762304 | 11/1956 | United Kingdom | 297/284.7 |

*Primary Examiner*—Peter R. Brown
*Attorney, Agent, or Firm*—Natter & Natter

[57] ABSTRACT

A chair having a backrest with an adjustable contour includes a slidable lumbar member for selectively changing the location of the contour in correspondence with the anatomy of the chair occupant. The lumbar member is displaceable within a travel slot. A handlebar member is operable by a seated chair occupant for releasably locking the lumbar member at selected heighth positions.

9 Claims, 4 Drawing Sheets

CHAIR HAVING A BACKREST WITH AN ADJUSTABLE CONTOUR

BACKGROUND OF THE INVENTION

1. Field of the Invention

This invention relates generally to a chair having a backrest with a changeable support surface and especially to adjustable contour backrest.

In particular, this invention concerns a backrest for providing support to the lower back region of a chair occupant.

2. Background Art

Current seating designs for office furniture, such as task chairs, commonly incorporate multiple positional features for user comfort. With regard to backrest designs, various concepts have been utilized to support the natural curve of the spine and to relieve stress on the lumbar vertebrae.

Typical of such designs are chairs having an inflatable air lumbar support mechanism for increasing and/or decreasing the convexity of a backrest as illustrated in U.S. Pat. No. 5,660,438. A chair having a mechanically operable camming device for imparting a curvature to a backrest is disclosed in U.S. Pat. No. 3,948,558. The backrest of the chair shown in U.S. Pat. No. 4,601,514 relies upon a spring member for varying the curvature.

A limitation of the above-described backrests is that each is primarily concerned with curvature variations in the backrest without compensation for the differences in location of the lumbar region of respective chair occupants.

The backrest disclosed in U.S. Pat. No. 3,642,319 utilizes a shaft having an eccentric rotary axis for modifying the convexity of and for positionally relocating the contour. A disadvantage of this mechanism is that it cannot be readily operated by a chair occupant while seated in the chair.

Additional backrest designs for positionally adjusting a lumbar support are respectively shown in U.S. Pat. Nos. 5,217,278 and 4,156,544. These backrest devices employ complex control mechanisms and are intended for use in vehicle seats rather than for office furniture.

The backrest of the present invention in contrast to the previously described devices provides a relatively simple construction and has a plurality of contour elevational settings.

SUMMARY OF THE INVENTION

The nature of this invention involves a chair with a contour backrest that is changeable in a heighth direction.

Briefly, the chair of this invention includes a backrest attached to a chair seat by a bracket extending from a bottom of the seat to a rear face of the backrest. A sleeve member is slidably mounted on the bracket. An extension arm projecting from the bracket secures a lumbar member. The lumbar member is positioned behind a resilient cushion for defining a backrest contour. The sleeve member is manually displaceable by the chair occupant using a handlebar member extending below the backrest. The lumbar member can be moved to selected positions by the seated chair occupant.

In view of the foregoing, it should be apparent that the present invention overcomes many of the limitations of the background art and provides an improved heighth adjustable contour backrest. A feature of this invention is that the lumbar member is adapted for incremental vertical positioning in correspondence with anatomical characteristics of the chair occupant.

A preferred object of this invention is to provide a chair with an adjustable contour backrest which offers improved comfort features.

A further preferred object of this invention is to provide a chair that is relatively simple in construction, attractive in appearance, reliable in use, and well adapted for mass production fabrication techniques.

With these ends in view, the invention finds embodiment in certain combinations of elements and arrangements of parts by which the aforementioned objects and certain other preferred objects are hereinafter attained all as more fully described with reference to the accompanying drawings and the scope of which is more particularly pointed out and indicated in the appended claims.

BRIEF DESCRIPTION OF THE DRAWINGS

In the accompanying drawings, in which is shown an exemplary embodiment of the invention.

DESCRIPTION OF THE INVENTION

With specific reference now to the figures in detail, it is to be stressed that the particulars shown are by way of example and for the purpose of illustrative discussion of the preferred embodiment of the present invention and is presented in the cause of providing what is believed to be the most useful and readily understood description of the principles and conceptual aspects of the invention. In this regard, no attempt is made to show structural aspects of the invention in more detail than is necessary for a fundamental understanding of the invention, the description taken together with the drawings making apparent to those skilled in the art how the invention may be embodied in practice.

Figure 1:
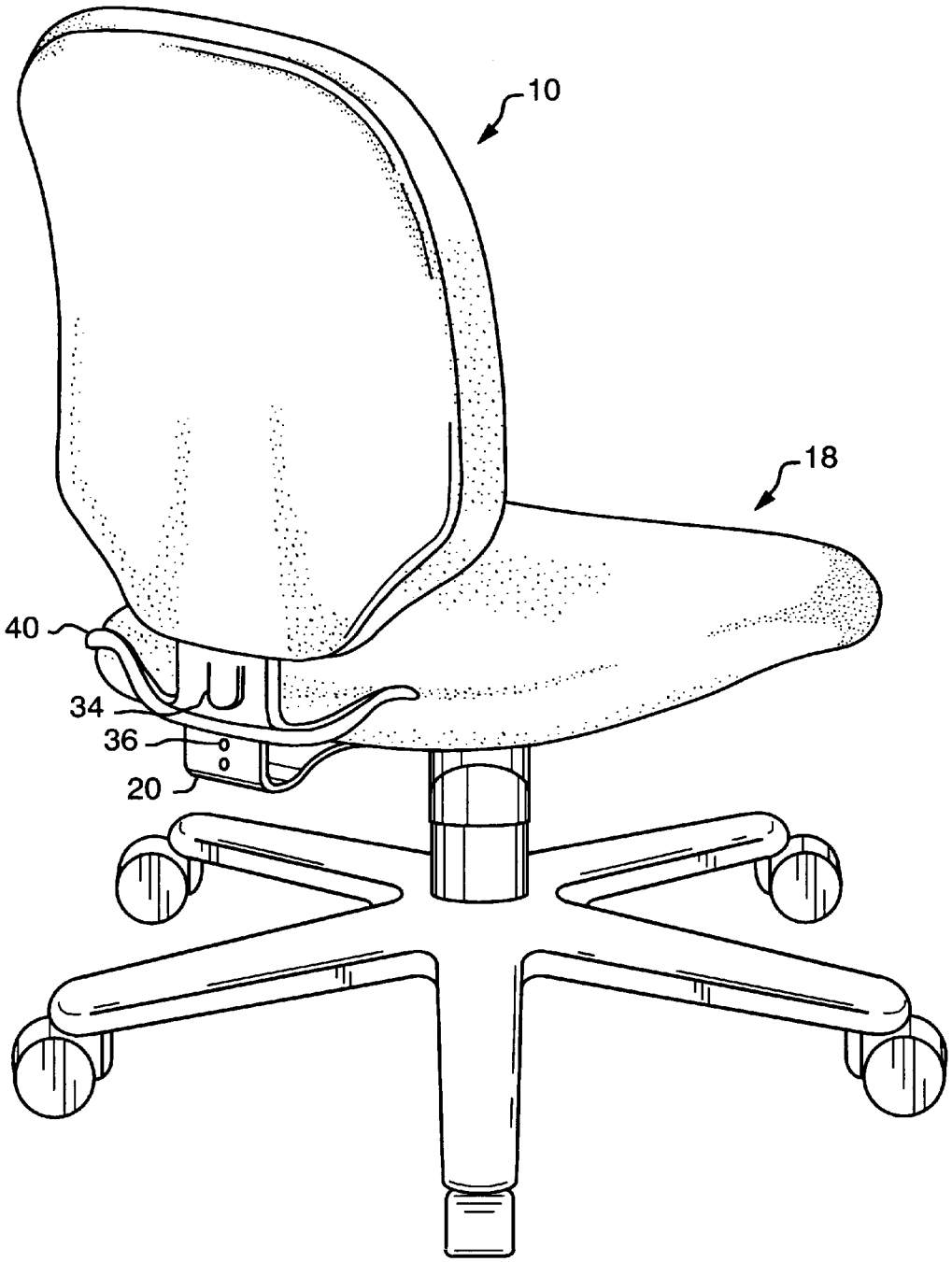
FIG. 1 is a rear elevational view in perspective, of chair having a backrest with an adjustable contour in accordance with the principles of this invention showing a bracket, a sleeve member slidably mounted on the bracket and an extension arm projecting from the bracket.
Figure 1A:
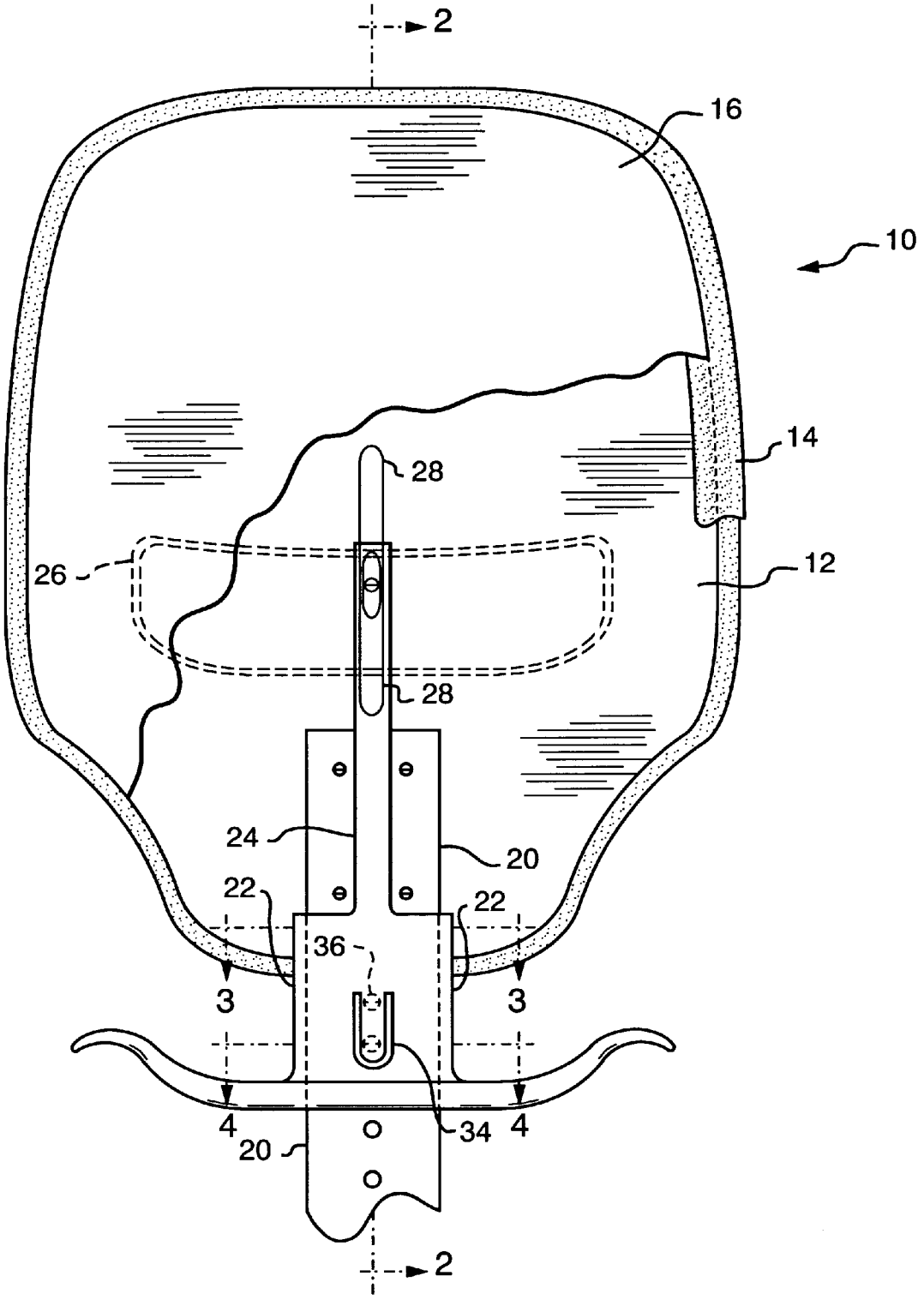
FIG. 1A is an elevational view of the backrest of FIG. 1 with a portion cut-away for showing the relationship between the bracket and the sleeve member and further illustrating the location of a lumbar member.

With reference now to FIGS. 1 and 1A, there is shown a backrest in accordance with this invention denoted generally by the reference numeral 10. The backrest 10 includes a backpan 12, typically constructed of laminated wood, plastic or steel, which provides a structural frame. A cushion 14, preferably made of a resilient foam or other elastomeric material, is secured to a front face of the backpan 12 and provides a resiliently deformable back support surface. A shroud 16, such as a fabric or plastic panel or similar covering material, encloses a rear face of the backpan 12.

Figure 2:
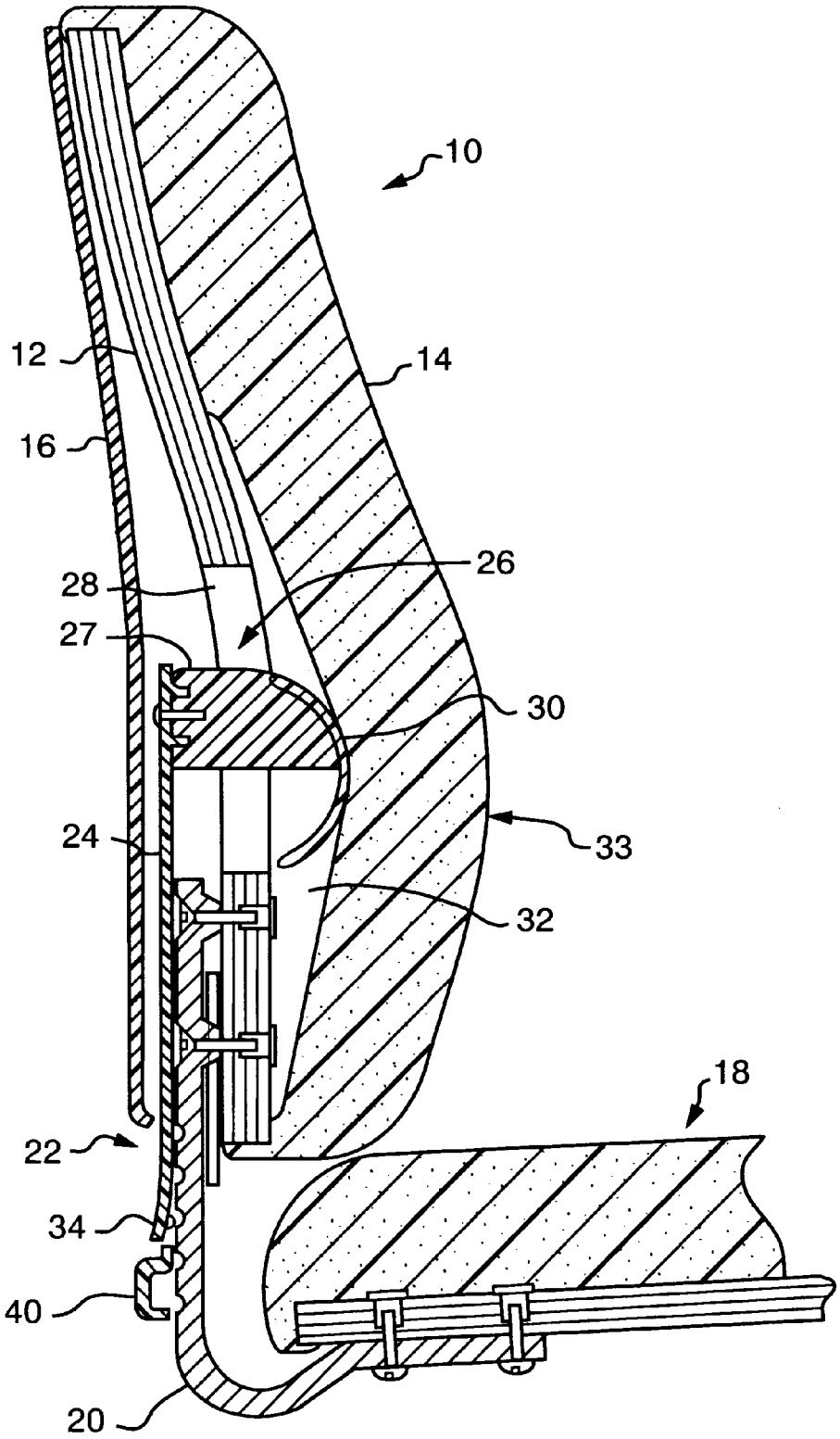
FIG. 2 is a side elevational view taken substantially along line 2—2 of FIG. 1A showing a lumbar member attached to an upper end of the extension arm.
Figure 3:
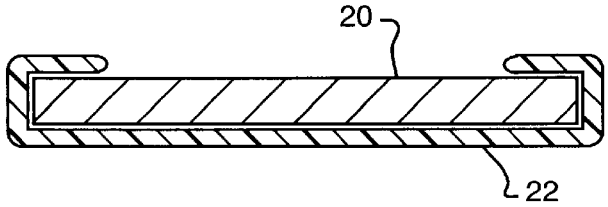
FIG. 3 is a sectional view, to an enlarged scale, taken substantially along lines 3—3 of FIG. 1A showing, in detail, a slidable mounting of the sleeve member on the bracket.

As illustrated in FIG. 2, the backrest 10 is mounted to a chair seat 18, by a bracket 20, preferably fabricated of steel or equivalent material and having a uniform width and thickness. The bracket 20 is attached at its respective opposite ends to an underside of the seat 18 and to a rear face of the backpan 12 by a screw-type fastener or a similar connector.

A sleeve member 22, as shown in FIG. 1A, is preferably fabricated of a flexible thermoplastic material, and is mounted on the bracket 20 for slidable displacement along a vertical axis. It should be apparent that the bracket 20 functions as a track or guide for the sleeve member 22 and that appropriate tolerances and lubricity between the respective surfaces are provided to insure smooth operation of the sleeve member 22.

An extension arm 24, preferably formed integrally with the sleeve member 22, projects from an upper end of the sleeve member 22 and extends along the rear face of the backpan 12 and supports a lumbar member 26. The lumbar member 26 as noted in FIG. 2, is accommodated within a substantially vertical travel slot 28 formed in the backpan 12.

The lumbar member 26 includes a horizontal pressure distribution element or block 27. The block 27 has a co-extensive arcuate nose portion 30 which is adapted to bear against and displace the cushion 14 away from the backpan 12 to define a cavity 32 which provides a corresponding convex contour 33 in the cushion 14.

Figure 4:
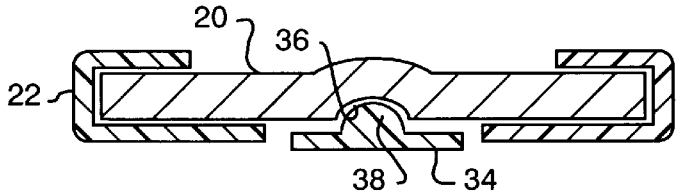
FIG. 4 is a sectional view, to an enlarged scale taken substantially along lines 4—4 of FIG. 1A showing in detail, a tongue member having a ball detent seated within a recess in the bracket.
Figure 5:
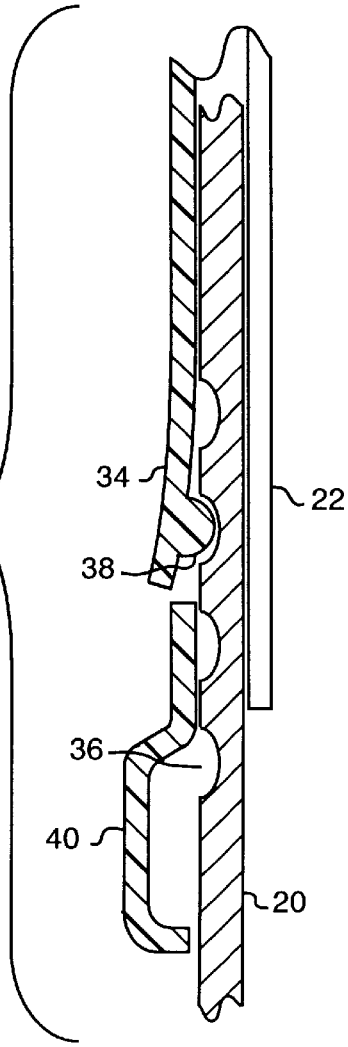
FIG. 5 is an auxiliary sectional view to an enlarged scale, illustrating in detail, the ball detent seated within one of a plurality of recesses for releasable securing the lumbar member in selected positions.

The travel slot 28 defines a path of movement for positioning the lumbar member 26 at selected locations. With regard to the heighth adjustment, reference is made to FIGS. 1A and 5. The sleeve member 22 defines a flap or tongue 34, typically formed by a u-shaped cut extending transversely through the sleeve member 22. The tongue 34, is resiliently flexible and is urged toward the bracket 20. The bracket 20 is provided with a series of recesses 36 that are uniformly spaced to correspond with predetermined heighth stops. The tongue 34 is further provided with a boss or ball detent 38 adapted for registration with a selected recess 36, as shown in FIGS. 4 and 5, to releasable lock the lumbar member 26 at selected heighth positions. Alternatively, a recess can be formed in the sleeve member 22 and the bracket 20 can be provided with a plurality of registrable ball detents or equivalent arrangement.

A handlebar member 40 extends from a lower end of the sleeve member 22 and projects below the backrest 10 for one and/or two hand accessibility by the chair occupant while in a seated position. When an upwardly or a downwardly directed force is applied to the handlebar member 40, the ball detent 38 is released from the recess 36 against the spring action and the extension arm 24 concomitantly displaces the lumbar member 26 within the limitations of the travel slot 28 to a selected elevational setting. It should be apparent that movement of the lumbar member 26 within the cavity 32 is effective for positioning the convex contour 33 of the cushion 14 in correspondence with the lumbar region of the chair occupant. This can be readily determined when the occupant is seated.

It should thus be evident to those skilled in the art that the invention is not limited to the details of the foregoing illustrative embodiment and that the present invention may be embodied in other specific forms without departing from the spirit or essential attributes thereof. The present embodiment is considered in all respects illustrative and not restrictive, the scope of the invention being indicated by the appended claims rather than by the foregoing description, and all changes which come within the meaning and range of equivalency of the claims are therefore intended to be embraced therein.

Having thus described the invention, there is claimed as new and desired to be secured by Letters Patent:

1. A chair with an adjustable contour backrest comprising a seat, a bracket extending from said seat for supporting a backrest, said backrest including a backpan, a resilient cushion attached to a front face of the backpan, said backpan including a substantially vertical slot, a lumbar member slidably accommodatable within said slot, with said lumbar member displacing the cushion to define a contour in said cushion, further including a sleeve member mounted to the bracket for relative movement, said sleeve member being connected to the lumbar member for selectively changing the vertical position of the lumbar member.

2. A chair with an adjustable contour backrest as claimed in claim 1 wherein one end of the bracket is attached to a rear face of the backpan, with said bracket providing a guide for the sleeve member movement.

3. A chair with an adjustable contour backrest as claimed in claim 1 further including a handlebar member extending from the sleeve member, said handlebar member being positioned below the backrest for accessibility by a seated chair occupant.

4. A chair with an adjustable contour backrest as claimed in claim 1 further including releasable locking means on the sleeve member and the bracket for limiting the relative movement to thereby secure the lumbar member at selected vertical positions.

5. A chair with an adjustable contour backrest as claimed in claim 4 wherein the releasable locking means includes a tongue member formed in the sleeve member, said tongue member being adapted for cooperative interaction with the bracket.

6. A chair with an adjustable contour backrest as claimed in claim 5 wherein the tongue member is urged toward the bracket for engaging a detent within at least one of a plurality of recesses formed in the bracket member to secure the lumbar member at a selected vertical position.

7. A chair with an adjustable contour backrest as claimed in claim 1 wherein said lumbar member includes a substantially horizontal pressure distribution element for displacing the cushion away from the backpan.

8. A chair with an adjustable contour backrest as claimed in claim 7 wherein the distribution element includes a nose portion, said nose portion being adapted to define the contour in the cushion.

9. A chair with an adjustable contour backrest as claimed in claim 1 further including an extension arm interposed between the sleeve member and the lumbar member with said lumbar member being connected to an end of the extension arm.

* * * * *